US005395422A

United States Patent [19]

Schulz et al.

[11] Patent Number: 5,395,422

[45] Date of Patent: * Mar. 7, 1995

[54] PROCESS OF PREPARING NANOCRYSTALLINE POWDERS OF AN ELECTROACTIVE ALLOY

[75] Inventors: Robert Schulz, Horizon; Jean-Yves Huot, St-Hubert; Michel Trudeau, Longueuil, all of Canada

[73] Assignee: Hydro-Quebec, Montreal, Canada

[ * ] Notice: The portion of the term of this patent subsequent to May 12, 2009 has been disclaimed.

[21] Appl. No.: 876,919

[22] Filed: Apr. 30, 1992

Related U.S. Application Data

[63] Continuation-in-part of Ser. No. 396,677, Aug. 22, 1989, Pat. No. 5,112,388.

[30] Foreign Application Priority Data

Apr. 30, 1991 [WO] WIPO ..... PCT/CA91/00143

[51] Int. Cl.[6] ..... B22F 1/00

[52] U.S. Cl. ..... 75/255; 147/33

[58] Field of Search ..... 75/255; 149/33

[56] References Cited

U.S. PATENT DOCUMENTS 4,358,475 11/1982 Brown et al. ..... 427/34
4,799,955 1/1989 McClellan ..... 75/247

OTHER PUBLICATIONS

Int. J. Hydrogen Energy, vol. 7, No. 5, pp. 405–410, 1987, D. E. Brown, et al., "Low Overvoltage Electrocatalysts for Hydrogen Evolving Electrodes".

Electrochimica Acta, vol. 29, No. 11, pp. 1551–1556, 1984, D. E. Brown, et al., "Preparation and Characterization of Low Overvoltage Transition Metal Alloy Electrocatalysts for Hydrogen Evolution in Alkaline Solutions".

Appl. Phys. Lett., vol. 49, No. 3, Jul. 21, 1986, pp. 146–148, R. B. Scharz, "Formation of Amorphous Alloys by the Mechanical Alloying of Crystalline Powders of Pure Metals and Powders of Intermetallics".

Symposium, Multicomponent Ultrafine Microstructures, Nov. 30–Dec. 1, 1988, 6 pages, E. Hellstern, et al., "Mechanism of Achieving Nanocrystalline A1Ru by Ball Milling".

D. E. Brown, "The Development of Low Overvoltage Cathodes", pp. 233–245.

Physica B., vol. 153, pp. 93–135, 1988, A. W. Weeber, et al., "Amorphization by Ball Milling. A Review".

*Primary Examiner*—Upendra Roy

*Attorney, Agent, or Firm*—Oblon, Spivak, McClelland, Maier & Neustadt

[57] ABSTRACT

There are described powders comprising agglomerated nanocrystals of an electroactive alloy and oxygen. The main component of the alloy can be of nickel, cobalt, iron or mixtures thereof while the alloying element is one or more transition metals such as Mo, W, V, the alloy also including oxygen. Preferably the nanocrystals will be made of an alloy of nickel, molybdenum and oxygen. An electrode which is used by compacting the powders is also disclosed. Also disclosed, is a process for producing the powders by providing particles of nickel, cobalt and iron or oxides thereof with particles of at least one transition metal, (Mo, W, V) or oxides thereof and subjecting the particles to high energy mechanical alloying such as ball milling under conditions which include oxygen and for a sufficient period of time to produce a nanocrystalline alloy. Electrodes produced from these powders have an electrocatalytic activity for the hydrogen evolution which is comparable or higher than the electrodes which are presently used in the electrochemical industry. Moreover, these materials present an excellent chemical, electrochemical and mechanical stability. When use as a cathode the powders are useful in water electrolyzers, in chlor-alkali or the like cells.

14 Claims, 12 Drawing Sheets

OXYGEN CONTENT OF POWDER AS A FUNCTION OF CRUSHING TIME UNDER AIR AND ARGON

OXYGEN CONTENT OF POWDER AS A FUNCTION OF CRUSHING TIME UNDER AIR AND ARGON

OVERVOLTAGE FOR HYDROGEN EVALVEMENT AS A FUNCTION OF TIME OF CRUSHING FOR THE MIXTURE $Ni_{75}Mo_{25}$ CRUSHED UNDER AIR AND UNDER ARGON

PROCESS OF PREPARING NANOCRYSTALLINE POWDERS OF AN ELECTROACTIVE ALLOY

This application is a continuation-in-part of Ser. No. 07/396,677, filed Aug. 22, 1989, which is now U.S. Pat. No. 5,112,388.

BACKGROUND OF INVENTION

1. Field of the Invention

This invention relates to powders suitable for manufacturing electrodes adapted for producing hydrogen by electrolysis such as in water electrolyzers, chlorate and also capable of being used in chlor-alkali or the like cells. More particularly, the invention is concerned with the manufacture of nanocrystalline powders of alloys of nickel, molybdenum and oxygen by high energy mechanical deformations, said powders having a high electrocatalytic activity for hydrogen evolution when used in water electrolyzers, chlor-alkali, chlorate and the like cells.

2. Description of Prior Art

It is known that a successful electrolysis of alkaline water can be achieved using an electrode consisting of an alloy of an element selected from the group consisting of nickel, cobalt, iron and one from Mo, W, V. Such an electrode is normally made of an alloy of nickel and molybdenum, wherein nickel is used in predominant amount.

U.S. Pat. No. 4,358,475 issued on Nov. 9, 1982 to the British Petroleum Company Limited discloses a method of producing metal electrodes by coating a substrate with a homogeneous solution of compounds of iron, cobalt or nickel and compounds of molybdenum, tungsten or vanadium. The coated substrate is thereafter thermally decomposed to give an oxide-coated substrate which is then cured in a reducing atmosphere at elevated temperature. This method produces good electrodes but is obviously complicated, expensive to achieve and time consuming. The same technology is also disclosed in the following publications:

Int. J. Hydrogen Energy, Vol. 7, No. 5, pp. 405–410, 1987, D. E. Brown et al.

Electrochimica Acta, Vol. 29, No. 11, pp. 1551–1556, 1984, D. E. Brown et al.

On the other hand, alloys of nickel and titanium and of nickel and niobium in the form of amorphous powders have been produced by mechanical alloying in a laboratory ball/mill mixer, as disclosed in:

Appl. Phys. Lett. 49(3), 21 July 1986, pp. 146–148, Ricardo B. Schwarz et al.

E. Hellstern et al., at a Symposium on "Multicomponent Ultrafine Microstructures" held in Boston, Mass. on Nov. 30, 1988, discloses the preparation of nanocrystalline AlRu by ball milling. The process is essentially restricted to Ru and AlRu and there is no disclosure of the usefulness of the product obtained thereby.

D. E. Brown et al, in The Development of Low Overvoltage Cathodes, Electrode Coatings, pp. 233–245 disclose the suitability of nickel-molybdenum alloy coated electrodes in chlor-alkali cells.

Finally, A. W. Weeber et al. review the production of amorphous alloys by ball milling in: Physica B, Vol. 153, pp. 93–135, 1988, A. W. Weeber and H. Bakker.

The prior art is therefore completely devoided of any disclosure of electrodes which have been manufactured by mechanical alloying.

It is an object of the present invention to provide powders which can be used with advantage to produce electrodes that may be utilized in the electrolytic production of hydrogen.

It is another object of the present invention to provide powders having a unique morphology and microstructure, which differ from those produced by other techniques and which can be used with advantage to manufacture hydrogen producing electrodes.

It is another object of the present invention to manufacture low cost cathodes which can be used to produce hydrogen by means of a simple technique of fabrication without requiring chemical, thermal or electrochemical treatment of the materials.

It is another object of the present invention to provide an electroactive powder for the manufacture of electrodes without requiring a substrate during fabrication.

It is another object of the present invention to provide agglomerated nanocrystals of an alloy which may be used as a cathode for the production of chlorates.

It is another object of the present invention to produce chlorates by carrying the electrolysis in an electrolytic cell having a cathode comprising the above powders.

SUMMARY OF INVENTION

It is another object of the present invention to provide agglomerated nanocrystals of an alloy which could be used to manufacture electrodes that can be utilized in water electrolyzers, chlor-alkali or the like cells.

The present invention relates to powders comprising agglomerated nanocrystals of a main alloy of at least one first element selected from the group consisting of nickel, cobalt, iron and at least one second element selected from Mo, W or V, said alloy also including oxygen.

The invention also relates to a process for manufacturing powders suitable for preparing electrodes having electrocatalytic properties for the production of hydrogen. The process uses particles of at least one first component selected from the group consisting of nickel, cobalt or iron or oxides thereof and of at least one second component from Mo, W or V or oxides thereof and involves subjecting the particles to high energy mechanical alloying under conditions which are such that oxygen is incorporated into the alloy during milling if not already present, and for a sufficient period of time to produce nanocrystals.

The term nanocrystals means a crystal whose dimension is of the order of about 1 to 50 nanometers.

In practice, oxygen is introduced in the powders by high energy mechanical alloying in the presence of air or oxygen. It is also possible to obtain powders containing oxygen by admixing a certain amount of oxides of the alloying elements to provide the required quantity of oxygen.

The preferred combination for the agglomerated nanocrystals are nickel, molybdenum and oxygen.

Although the amounts of the various components forming the main alloy can vary to a large extent, in view of the higher cost of molybdenum compared to nickel, it has been found preferable to provide a main alloy which comprises at least about 50 At. % nickel, the balance comprising molybdenum and oxygen. For example, a main alloy which comprises from about 60 At. to about 85 At. % of nickel has shown to give excellent results. A typical alloy is one containing 60 At. % nickel and 40 At. % molybdenum exclusive of any amount of oxygen that it may contain, and another is one containing 85 At. % nickel and 15 At. % molybdenum, exclusive of any amount of oxygen that it may contain. These two concentrations of nickel, have been tested and have given impressive results as will be shown later, indicating that this technique can be successfully applied on a relatively wide concentration range.

The powders obtained are pressed or consolidated at cold or moderate temperatures to prevent recrystallisation and segregation. It will therefore be realised that the metallic powders according to the invention can be sold as such to be later transformed into an electrode. Previously, the electrode had to be prepared in final form. In the present case, it is merely necessary to obtain the powders, and to press it on any kind of support such as a grid or a plate to constitute an electrode.

Finally, the surface of the pressed powder forming an electrode could be post treated, such as by oxidation-reduction, low temperature thermal treatment to give even better results as it is well known to those skilled in the art.

As mentioned above, according to the invention, the process involves high energy mechanical alloying to produce powders of an alloy such as nickel/molybdenum and oxygen, whose micro-struture in this case is that of an agglomerate of nanocrystals, i.e. crystals whose dimension is of the order of about 1 to 50 nanometers.

The expression high energy used in the present invention in association with the term "mechanical alloying", is intended to means that the mechanical alloying is sufficient to cause a rupture of the crystals of the alloy as well as allowing sufficient interdiffusion between the elementary components.

In practice, the mechanical alloying according to the invention is carried out by ball milling although any other techniques such as grinding of the particles or cold rolling of thin elementary foils could also be used.

In practice, when ball milling is used, it should be carried out in a crucible and with balls which do not excessively contaminate the final product. The ball milling must be carried under an atmosphere containing some oxygen if this element is not already present in the initial mixture. Oxygen contents larger than 2 weight % are preferred. In this case, ball milling is carried out in a crucible of a carbide of a transition metal, with balls made of the same material. A preferred material is tungsten carbide because of its hardness and because this material is readily available. Molybdenum carbide could also be used.

Although the proportions of the particles of nickel and molybdenum can vary to a large extent, they should be selected to achieve an alloy whose content of nickel and molybdenum is as mentioned above, such as containing at least about 50 At. % nickel, preferably, from about 60 to 85 At. % nickel and about 15 to 40 At. % molybdenum exclusive of any amount of oxygen. Good results have been obtained, as indicated above with a main alloy comprising 60 At. % nickel and 40 At. % molybdenum and another alloy comprising 85 At. % nickel and 15 At. % molybdenum, the oxygen content being of the order 2 to 15 weight %.

During the milling process, the speed of the balls is typically greater than about 1 meter per second. Good results have been obtained when the operation is carried out for a period of time of few hours under these conditions.

When the operation in the ball mill lasts for a long period of time (more than typically 25 hours), in addition to the nanocrystals of nickel-molybdenum, minor amounts of tungsten carbide have been found, an impurity phase which comes from the crucible. The presence in minor amounts of this impurity phase, however, does not seem to affect the electrocatalytic performance of the alloy as shown in FIG. 1.

After obtaining powders of agglomerated nanocrystals of an alloy of nickel, molybdenum and oxygen, the powders could be pressed at a moderate temperature to prevent recrystallisation or phase segregation, in the form of an electrode or on a support, such as a grid or a plate to constitute an electrode. Other techniques such as painting, spraying, electro-codepositing could also be used.

It is believed that the production of nanocrystals in the powders according to the invention produces a large number of active sites, which are responsible for the high electrocatalytic activity of the electrode produced.

Molybdenum is responsible for the dilatation of the Ni crystals. In other words, high energy mechanical alloying such as ball milling forces molybdenum inside the crystals of nickel where it remains in spite of the phase diagram. At the start of the high energy mechanical alloying, the particles come in contact with one another and are bound together. After a few hours of mechanical alloying, during which the amount of deformation of the nickel and the molybdenum crystallites increases, there is a diffusion of the atoms of molybdenum inside the crystals of nickel, the latter being fragmented into units which are increasingly smaller. After about twenty hours of deformation, the structure of the powders consists of an agglomerate of crystals of nickel saturated with molybdenum, and also containing oxygen, whose dimension is lower than or of the order of 50 nanometers. These nanocrystals can be mixed with a small amount of an impurity phase coming from the tungsten carbide balls and from the crucible.

The presence of oxygen in the powers according to the invention enables to provide a gain of about 0.2 to 0.5 volt on the actual voltage used for each elementary cell at 250 mA $cm^{-2}$. In a typical industrial electrolyzer for the production of sodium chlorate this may provide savings of up to half a million dollars per one tenth volt which is gained on the usual operation voltage.

Electrodes manufactured from the powders according to the invention have presented, during tests made for the electrolysis of water at 70° C. in KOH 30 wt % an electro-catalytic activity which is comparable or higher than that of electrodes presently used in the electrochemical industry.

The overpotential measured at 250 mA $cm^{-2}$ in 30 weight % KOH at 70° C. is of 60 mV and at 500 mA $cm^{-2}$ it is about 90 mV.

These overpotentials are stable during the first 15 hours of operation. These performances are preserved after many interruptions or removals from the cell.

BRIEF DESCRIPTION OF THE DRAWINGS

The invention will now be illustrated by means of the following drawings in which.

DESCRIPTION OF PREFERRED EMBODIMENTS

Figure 1:
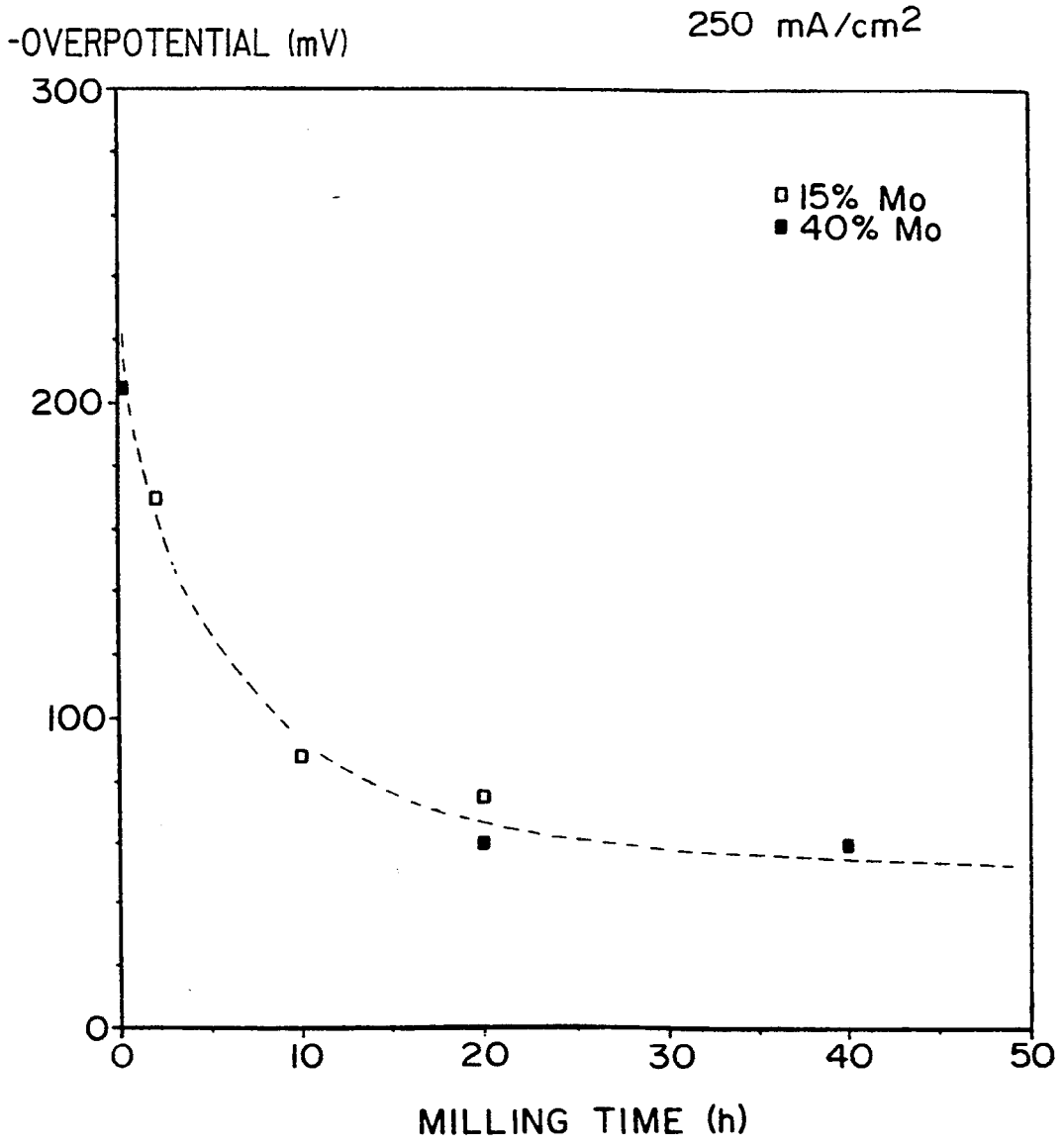
FIG. 1 is a curve representing the overpotential in a KOH solution at 70° C. with respect to milling time of alloys according to the invention containing respectively 15 At. % and 40 At. % molybdenum exclusive of any amount of oxygen.

Referring to FIG. 1, it will be seen that both the alloys containing 15 At. % molybdenum and 40 At. % molybdenum, have an acceptable overpotential already after about 10 hours of milling time. However, a real good overpotential is obtained after 20 hours and it will be noted that the potential slightly improves as the milling time is extended past 15 hours.

Figure 2:
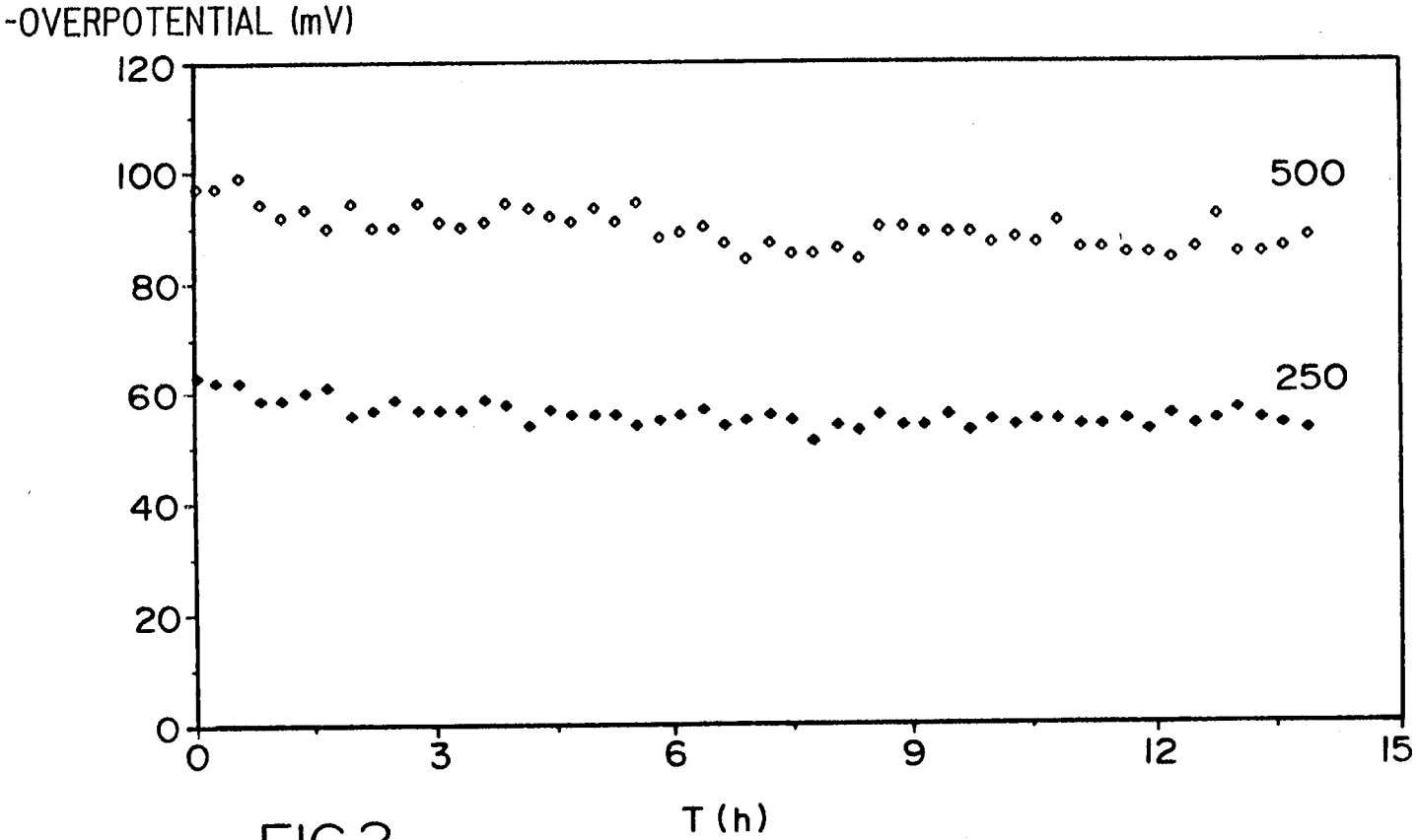
FIG. 2 shows the time dependence of the overpotential of $Ni_{60}Mo_{40}$ alloy according to the invention respectively at 500 and 250 mA $cm^{-2}$.

Referring to FIG. 2, it will be noted that an alloy having 40 At. % molybdenum shows a good overpotential, i.e. lower than 100 mV even after 15 hours of testing at 500 mA $cm^{-2}$.

Another indication of the good behavior of an alloy according to the invention, is given by measuring the Tafel slope, which is a measure of the increase of potential which should be applied to the electrode to obtain an increase of current by a factor of 10. Table 1 shows that the alloys display Tafel slopes lower than 70 mV after 20 and 40 hours of milling time. The calculated overpotentials at 250 mA $cm^{-2}$ ($\eta_{250}$) confirm the high electrocatalytic activity of the alloys.

TABLE 1

Tafel parameters[1] for the hydrogen evolution reaction in 30 wt % KOH, 70° C. on Ni—Mo alloys produced by intensive ball-milling

| alloy | milling time (h) | Tafel slope (mV) | $I_o$ (mA $cm^{-2}$) | $N_{250}$ |
|---|---|---|---|---|
| $Ni_{60}Mo_{40}$ | 0.25 | 166 | 14.8 | 204 |
| $Ni_{85}Mo_{15}$ | 2.0 | 156 | 22 | 165 |
| $Ni_{85}Mo_{15}$ | 10.0 | 73 | 15 | 89 |
| $Ni_{85}Mo_{15}$ | 20.0 | 63 | 16 | 75 |
| $Ni_{60}Mo_{40}$ | 20.0 | 50 | 17 | 58 |
| $Ni_{60}Mo_{40}$ | 40.0 | 63 | 29 | 59 |
| $Ni_{60}Mo_{40}$ | arc melted | 107 | 0.042 | 404 |

[1]Obtained by a galvanodynamic method for a sweep rate of 1 mA $cm^{-2}$ $s^{-1}$ from 250 to 10 mA $cm^{-2}$ after keeping the electrode at 250 mA $cm^{-2}$ for 1800s.

Figure 3:
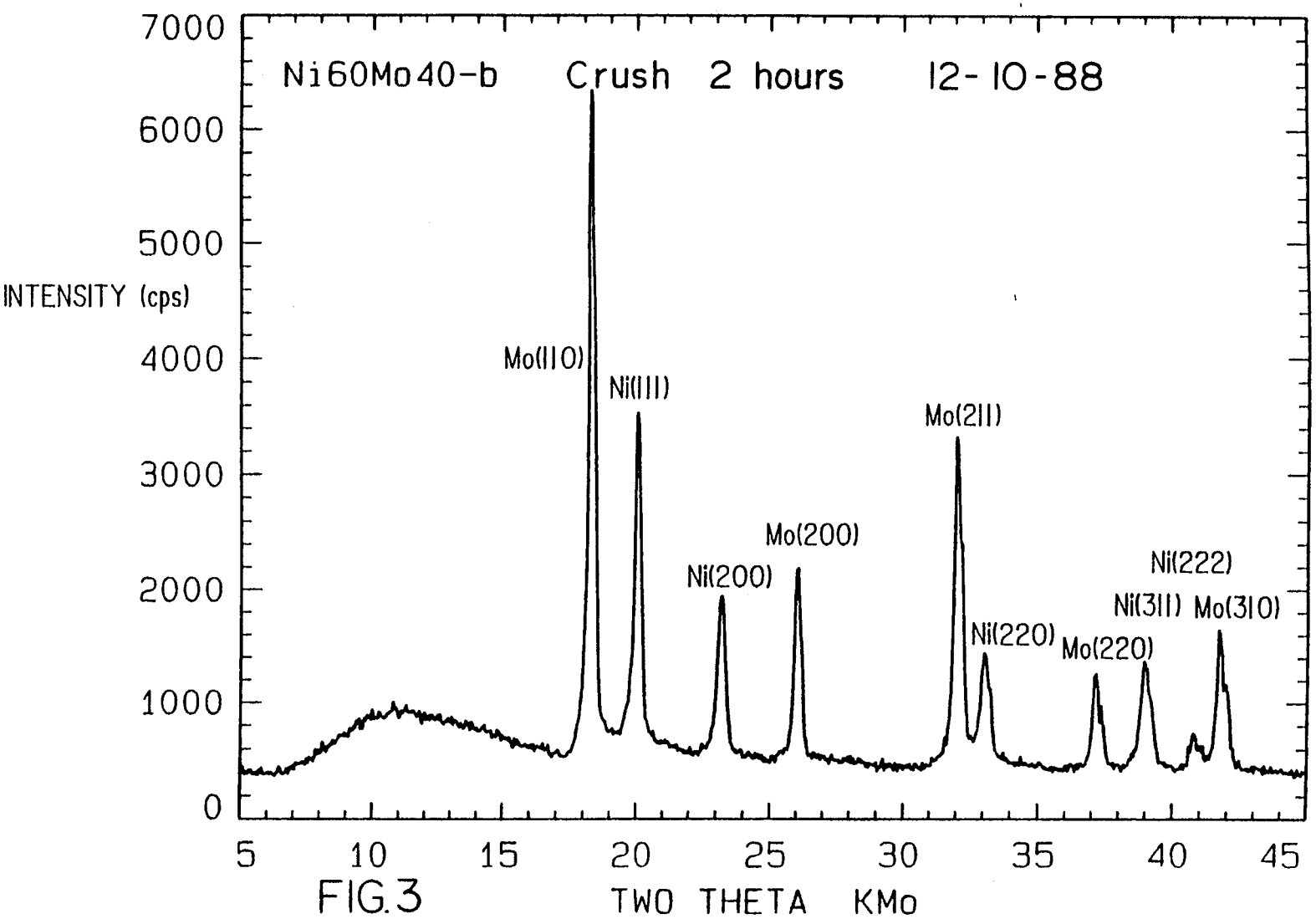
FIG. 3 is a curve representing the structure of an alloy containing 60 At. % nickel after two hours of ball milling.

Referring to FIG. 3, the structure of the mixture is shown after 2 hours of ball milling. It will be seen that the molybdenum phase is clearly separated from the nickel phase.

Figure 4:
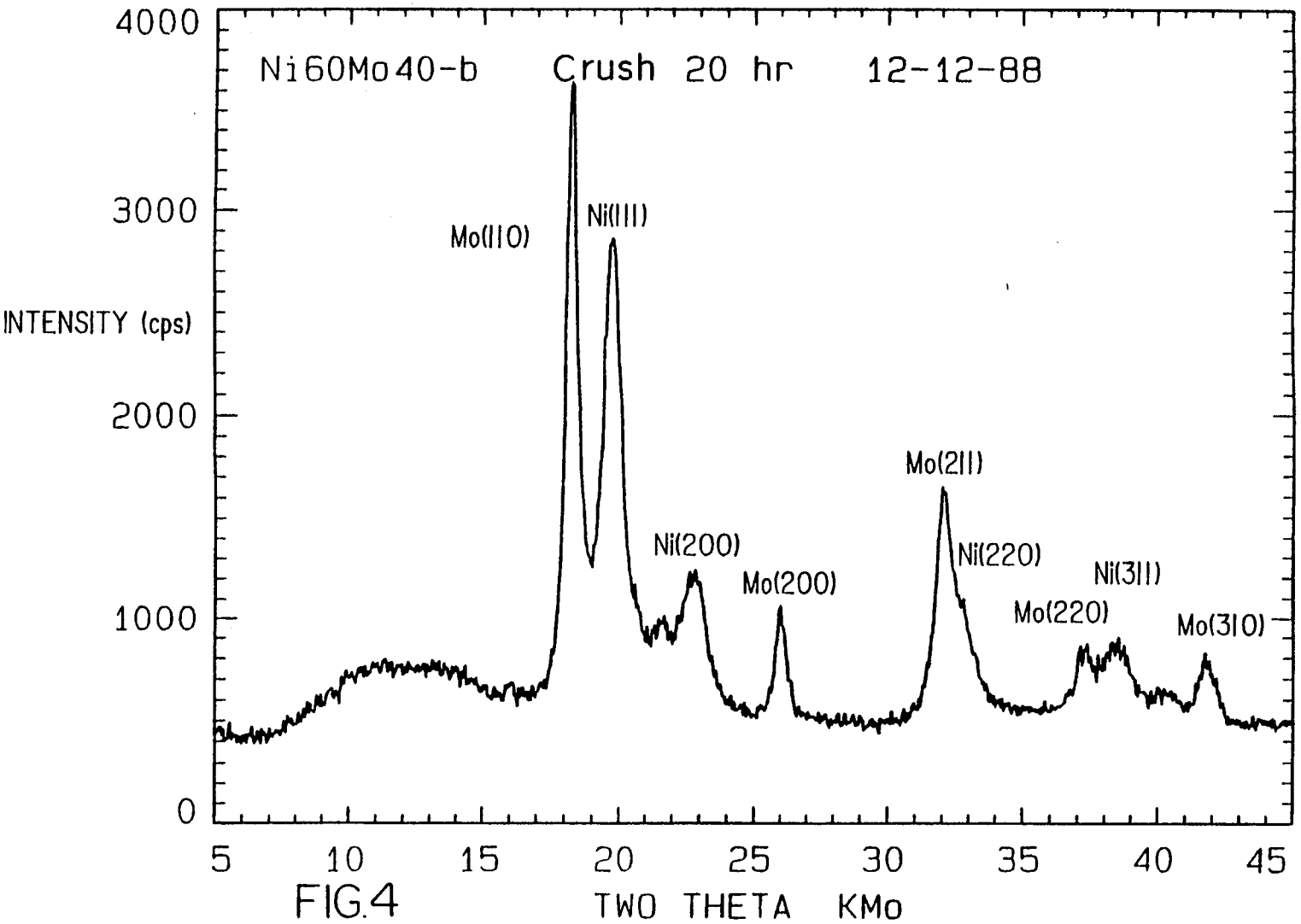
FIG. 4 is a curve similar to FIG. 3 after 20 hours of ball milling.

With respect to FIG. 4, it will be seen that the Mo peaks decrease in intensity with respect to the corresponding peaks of FIG. 3 indicating that molybdenum diffuses in the nickel, the widening of the peaks means that there is a reduction in the sizes of the crystallites.

Figure 5:
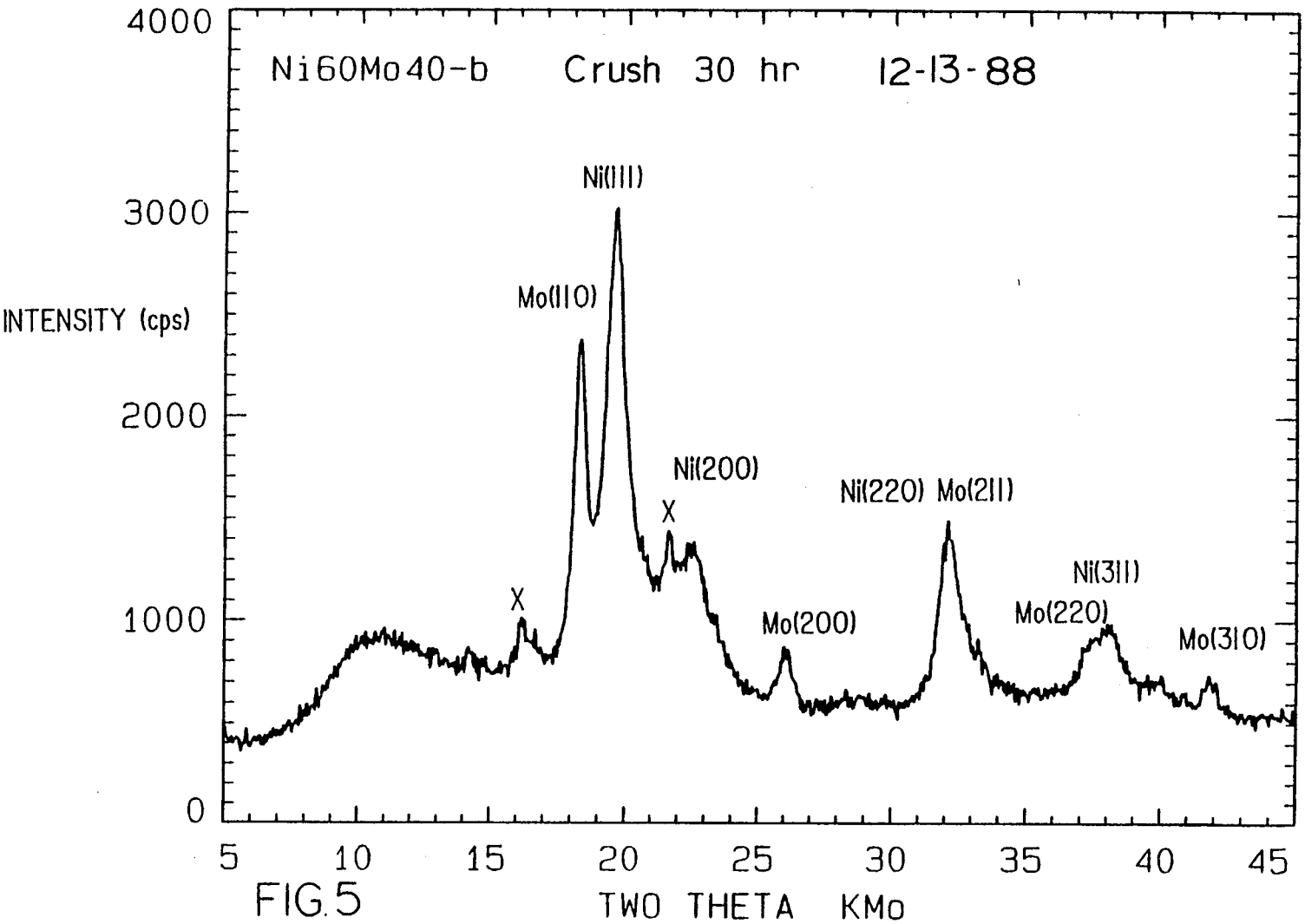
FIG. 5 is a curve similar to that of FIG. 3 after 30 hours of ball milling.

With respect to FIG. 5, it will be seen that the molybdenum peaks still decrease. This means that there is further diffusion of molybdenum in nickel which is also indicated by the fact that the peak (111) of nickel is displaced towards the left. One can also notice the start of the appearance of a secondary impurity phase, denoted by X, and identified as being Tungsten carbide.

Figure 6:
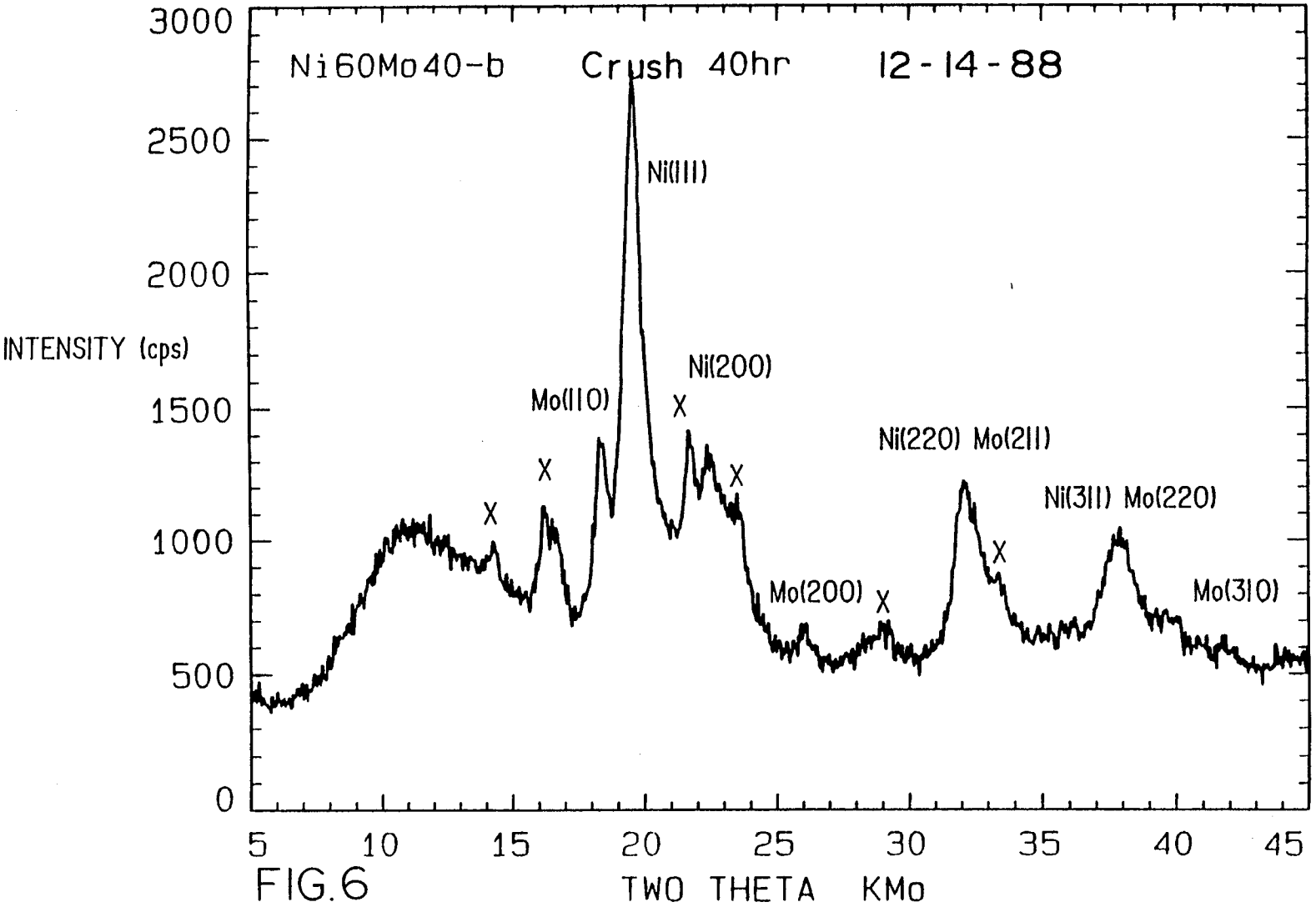
FIG. 6 is a curve similar to FIG. 3 after 40 hours of ball milling.

With reference to FIG. 6, there is an increase in the amount of secondary phase after 40 hours of milling time.

Figure 7:
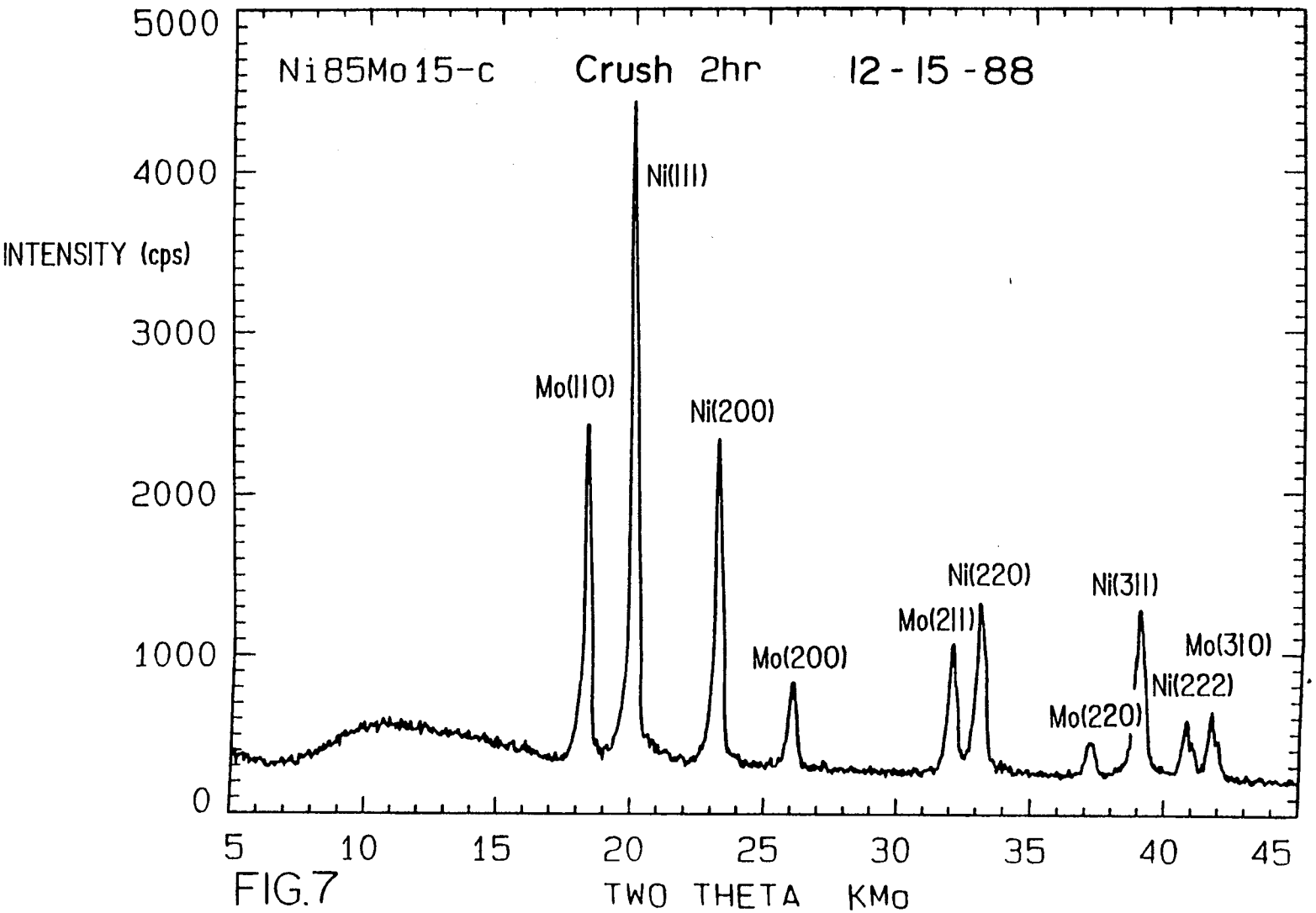
FIG. 7 is a curve similar to FIG. 3 for an alloy containing 85 At. % nickel and 15 At. % molybdenum.
Figure 8:
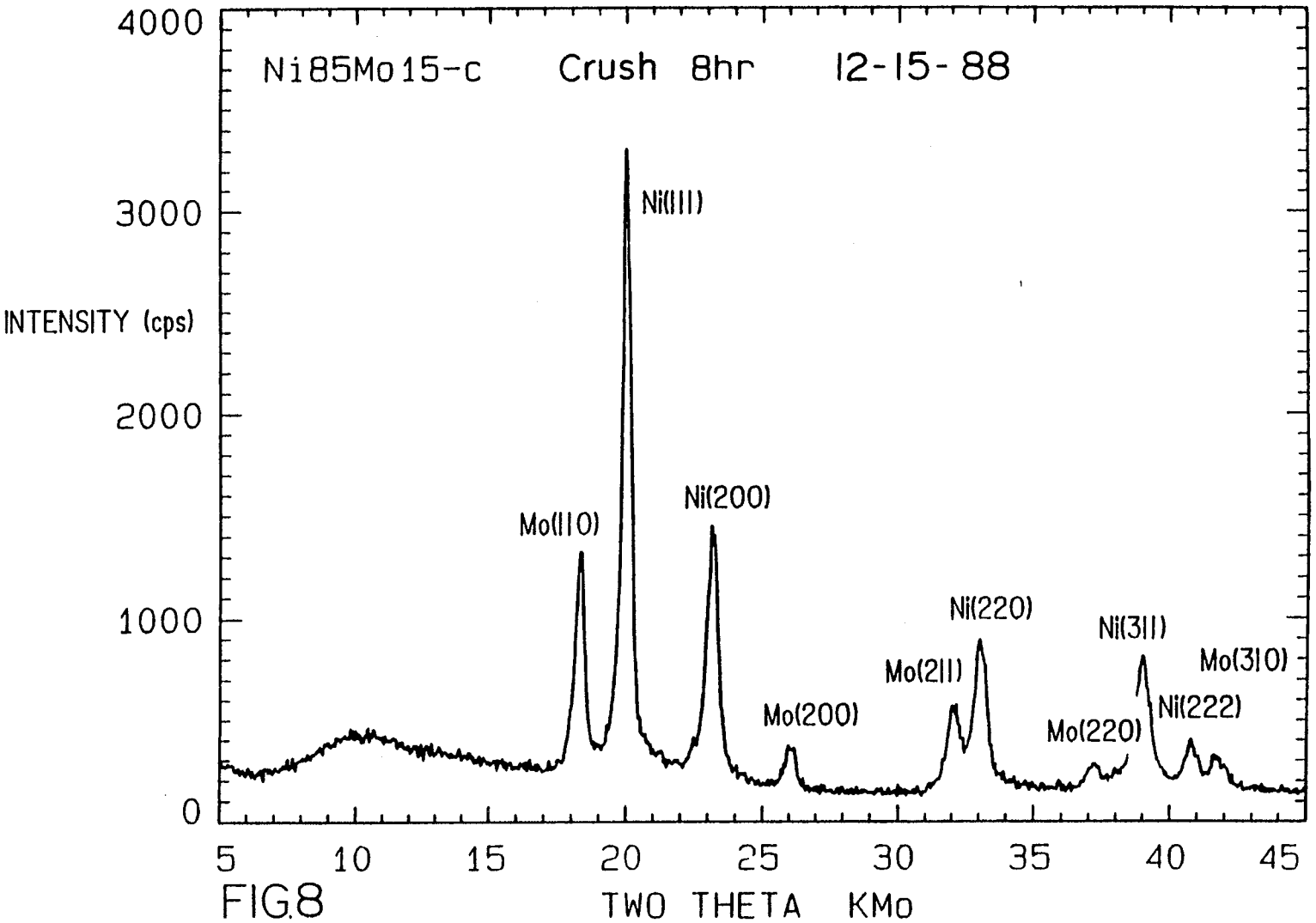
FIG. 8 is a curve similar to that of FIG. 7 after 8 hours of crushing.
Figure 9:
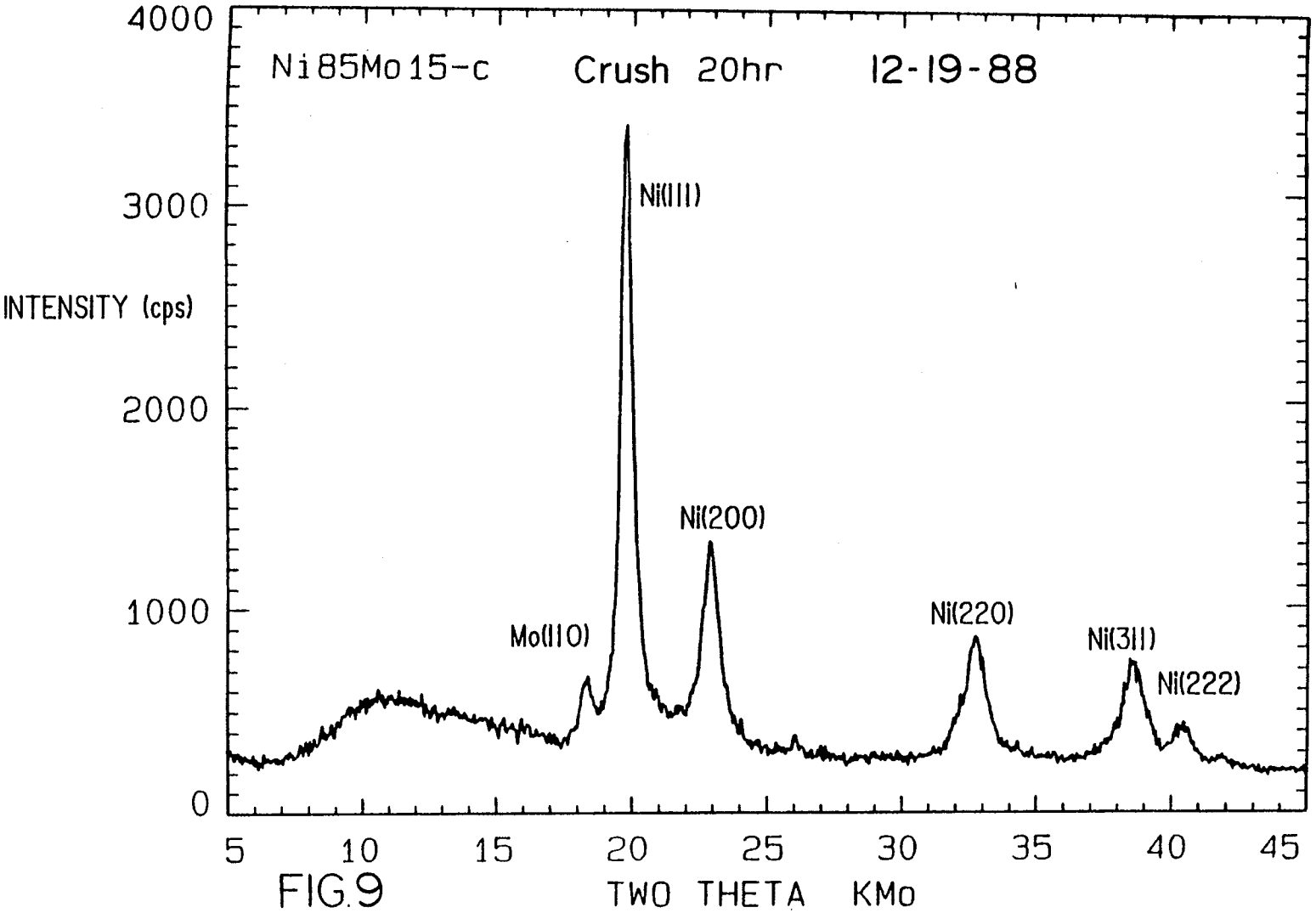
FIG. 9 is a curve similar to that of FIG. 7 after 20 hours of crushing.

FIGS. 7, 8 and 9 correspond to those which were given before for the alloy containing 60 At. % nickel but this time we are dealing with an alloy containing 85% nickel. The same results can be observed.

Figure 10:
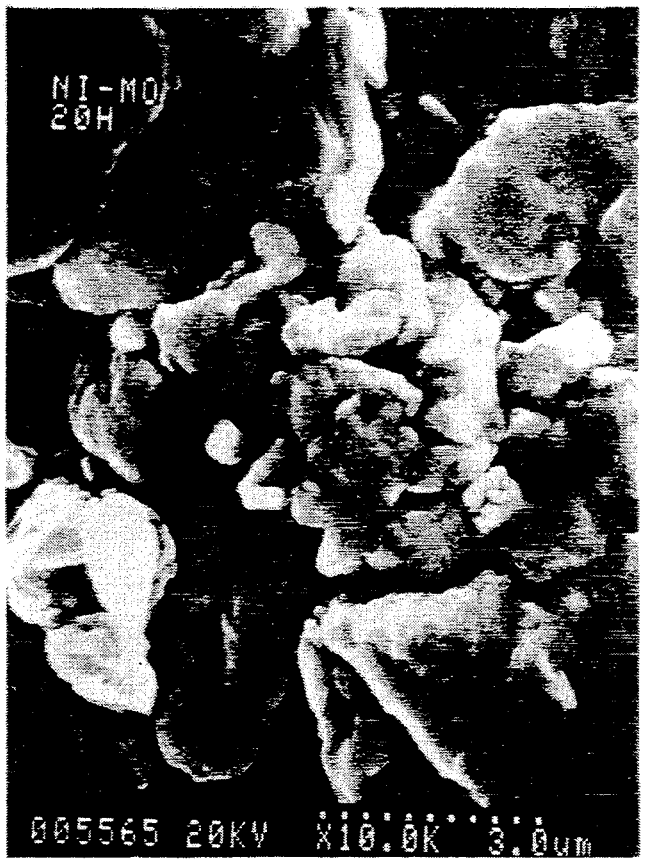
FIG. 10 shows the morphology of an alloy according to the invention containing 85 At. % nickel and 15 At. % molybdenum after 20 hours of ball milling.

The morphology shown in FIG. 10 shows that the surface of a consolidated powder electrode according to the invention is quite smooth on a microscopic scale. A treatment to roughen the surface in order to render the electrode even more active could be applied.

Figure 11:
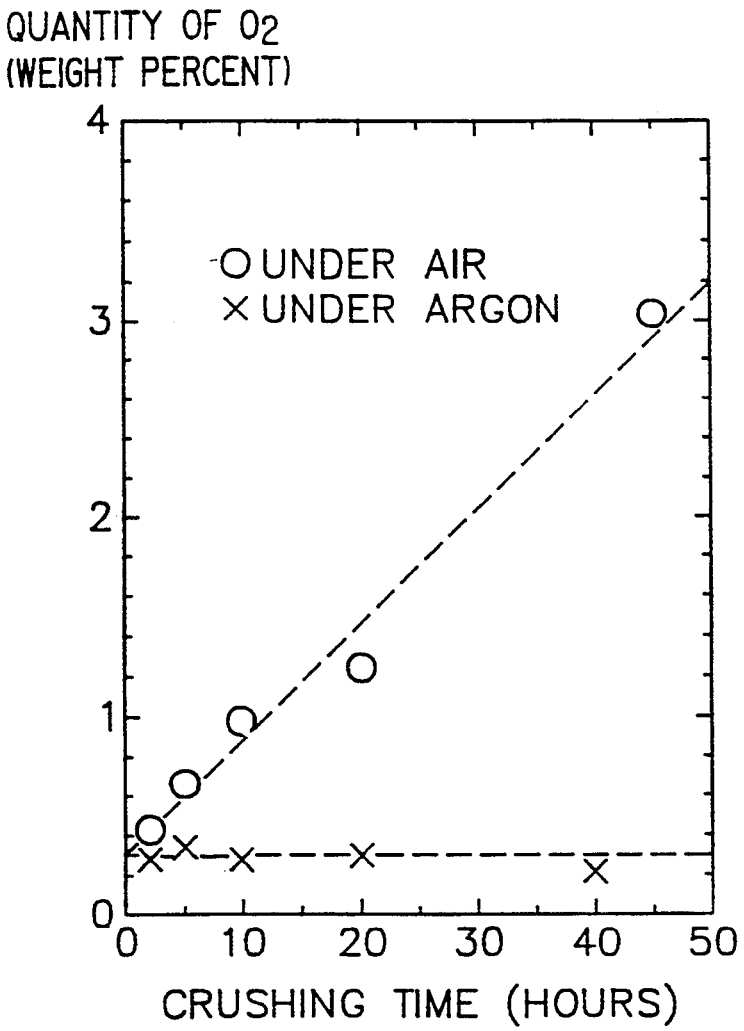
FIG. 11 is a curve showing the oxygen content of the powder as a function of the time of crushing in air or under an atmosphere of argon.

With reference to FIG. 11, it will be seen that the amount of oxygen which is present in the powders when the milling takes place under argon does not fluctuate. It can be presume that it represents any oxygen impurity which was present in nickel and mobybdenum and/or argon before crushing.

Figure 12:
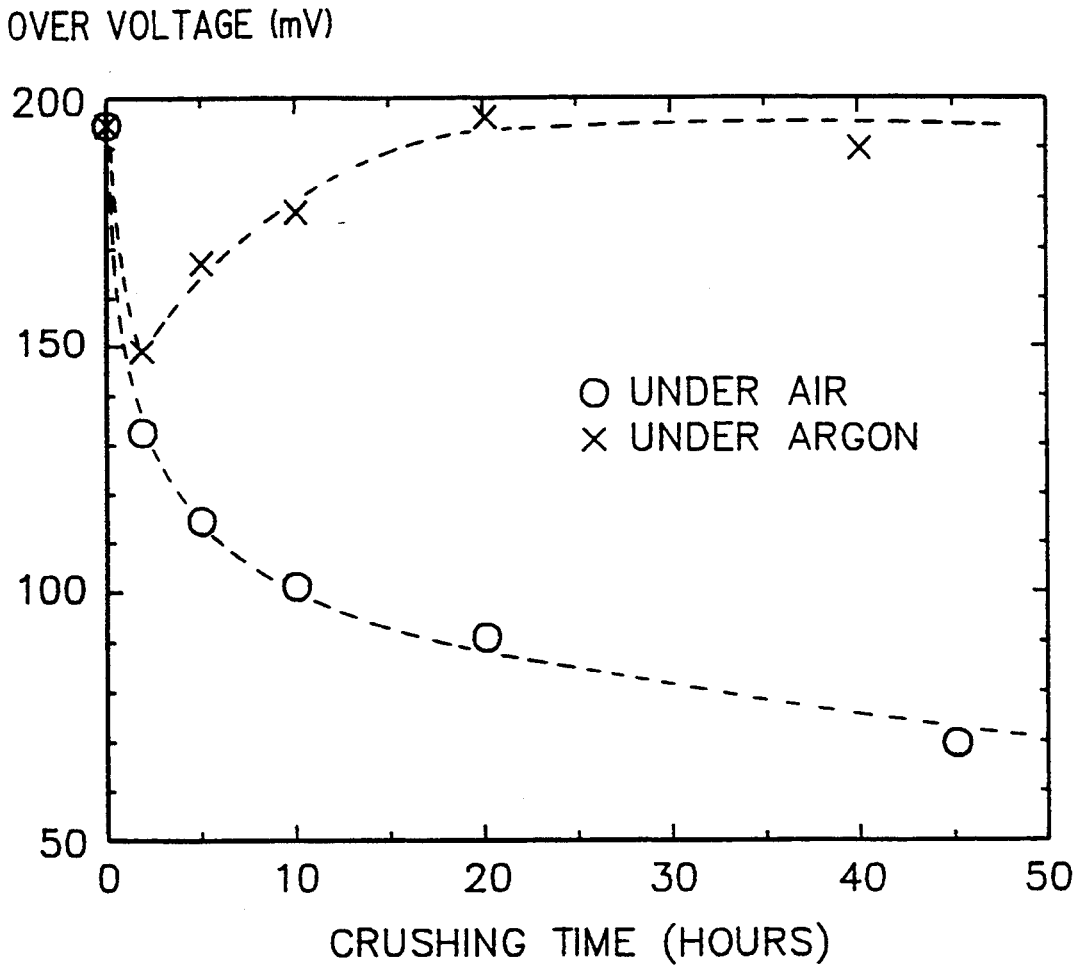
FIG. 12 shows the change of overvoltage as a function of time for a powder mixed under air and under argon.

On the other hand, it will be realized that the overvoltage (mV) measured for powders which have undergone different milling condition (air vs. argon) and varies substantially. It would appear that a reduction of the overvoltage is a direct result of the time of crushing and consequently of the amount of oxygen present in the powders. Reference is made to Table 2 and FIG. 12.

TABLE 2

| Samples | | Overvoltage (mV) | |
|---|---|---|---|
| Material | Time of crushing | Under air | Under Argon |
| Ni | 0 | 332 | |
| NiO | 0 | 270 | |
| Ni75:Mo25 | 0 | 194 | 194 |
| Ni75:Mo25 | 2 | 132 | 149 |
| Ni75:Mo25 | 5 | 114 | 167 |
| Ni75:Mo25 | 10 | 101 | 177 |
| Ni75:Mo25 | 20 | 91 | 196 |
| Ni75:Mo25 | 40 | — | 190 |
| No75:Mo25 | 45 | 70 | — |

Table 2 shows a substantial improvement of the catalytic properties of the cathodes when oxygen is incorporated into the structure of the powders. It must be therefore concluded that oxygen is mainly responsible for activating the structure of the alloy.

TABLE 3

| | Overvoltage (mV) | |
|---|---|---|
| Current Density (mA/CM²) | Crushed 31 hours (argon) | Crushed 41 hours (31 h argon + 10 h air) |
| 50 | 69 | 20 |
| 100 | 107 | 31 |

TABLE 3-continued

| Current Density (mA/CM$^2$) | Overvoltage (mV) Crushed 31 hours (argon) | Crushed 41 hours (31 h argon + 10 h air) |
|---|---|---|
| 200 | 166 | 35 |
| 250 | 183 | 39 |
| 400 | 223 | 41 |
| 500 | 229 | 48 |
| Tafel Slope | 160 mV/decade | 29 mV/decade |
| Exchange current | — | 11.4 mA/cm$^2$ |
| Quantity of oxygen (% weight) | 0.25 | 5.0 |

We claim:

1. A process for producing powders suitable for preparing electrodes having electrocatalytic properties enabling said electrodes to produce hydrogen in water-electrolyzers, chlor-alkali cells or chlorate-cells, said process comprising providing a mixture of particles of at least one first component selected from the group consisting of nickel, cobalt and iron or oxides thereof, and of at least one second component from Mo, W and V or oxides thereof, at least when no oxides are present in said mixture, placing said mixture in an atmosphere containing oxygen, and essentially subjecting said particles to high energy mechanical alloying for at least ten hours to produce nanocrystalline alloys of said components containing at least 1 wt % oxygen, which are suitable for preparing said electrodes.

2. The process according to claim 1, which comprises conducting said mechanical alloying to produce nanocrystals whose dimension varies between about 1 and 50 nanometers.

3. Process according to claim 1, wherein said high energy mechanical alloying is carried out by ball milling of said particles in an atmosphere containing oxygen.

4. Process according to claim 1, wherein said high energy mechanical alloying is carried out by grinding or cold-rolling in at atmosphere containing oxygen.

5. The process according to claim 1, which comprises providing particles of nickel and particles of molybdenum or oxides thereof in a proportion to produce nanocrystals of a main alloy of nickel and molybdenum comprising at least about 50 At. % nickel, the balance being molybdenum and at least 1 wt % oxygen.

6. Process according to claim 3, which comprises ball milling particles of nickel and particles of molybdenum or oxides thereof while adjusting speed of said ball greater than about 1 meter/second.

7. The process according to claim 5, wherein said main alloy comprises from about 60 to about 85 At. % nickel and about 15 to 40 At. % molybdenum, exclusive of said at least 1 wt % oxygen.

8. The process according to claim 5, wherein said main alloy comprises about 60 At. % nickel and 40 At. % molybdenum, exclusive of said at least 1 wt % oxygen.

9. The process according to claim 5, wherein said main alloy comprises about 85 At. % nickel and 15 At. % molybdenum, exclusive of said at least 1 wt % oxygen.

10. The process according to claim 5, wherein said powders comprise agglomerated nanocrystals of an alloy of nickel, molybdenum and at least 1 wt % oxygen and are consolidated at a temperature to prevent recrystallization and segregation of phases in said alloy, thereby enabling them to constitute an electrode.

11. Process according to claim 10, wherein said powders are pressed on a support comprising a grid.

12. Process according to claim 10, wherein said powders are pressed on a support comprising a plate.

13. The process according to claim 10, wherein said powders are consolidated by electro-codeposition, rolling, painting or spraying techniques.

14. In a process for producing chlorates by electrolysis, the improvement which comprises carrying out said electrolysis in an electrolytic cell having a cathode comprising powders comprising agglomerated nanocrystals of a main alloy containing at least one first element selected from the group consisting of nickel, cobalt and iron, and at least one second element selected from molybdenum, tungsten and vanadium, and at least 1 wt % oxygen, said powders being pressed to form an electrode, and are consolidated on a support by electrocodeposition, rolling, painting or spraying techniques to constitute an electrode.

* * * * *